US009010222B2

(12) United States Patent
Peirce

(10) Patent No.: US 9,010,222 B2
(45) Date of Patent: Apr. 21, 2015

(54) ADJUSTABLE GRIPPING TOOL

(71) Applicant: AGS I-Prop, LLC, Muskegon, MI (US)

(72) Inventor: John M. Peirce, Portage, MI (US)

(73) Assignee: AGS I-Prop, LLC, Muskegon, MI (US)

( * ) Notice: Subject to any disclaimer, the term of this patent is extended or adjusted under 35 U.S.C. 154(b) by 214 days.

(21) Appl. No.: 13/755,094

(22) Filed: Jan. 31, 2013

(65) Prior Publication Data

US 2013/0199342 A1 Aug. 8, 2013

Related U.S. Application Data

(60) Provisional application No. 61/660,275, filed on Jun. 15, 2012, provisional application No. 61/611,069, filed on Mar. 15, 2012, provisional application No. 61/595,375, filed on Feb. 6, 2012.

(51) Int. Cl.

| | |
|---|---|
| ***B25B 7/12*** | (2006.01) |
| ***B25B 7/14*** | (2006.01) |
| ***B25B 7/10*** | (2006.01) |

(52) U.S. Cl.

CPC ... *B25B 7/12* (2013.01); *B25B 7/10* (2013.01); *B25B 7/14* (2013.01)

(58) Field of Classification Search

USPC ..... 81/319, 324, 342–344, 352–356, 347, 81/363–366, 373, 376, 378–380, 407, 81/409–414, 427, 385

See application file for complete search history.

(56) References Cited

U.S. PATENT DOCUMENTS

| | | | | |
|---|---|---|---|---|
| 389,666 | A | | 9/1888 | Reagan |
| 726,013 | A | | 4/1903 | Aue |
| 988,656 | A | | 4/1911 | Peck |
| 1,106,518 | A | | 8/1914 | Matti |
| 1,508,510 | A | | 9/1924 | Edwards |
| 1,534,218 | A | | 4/1925 | Jones |
| 1,867,912 | A | | 2/1931 | Evey |
| 2,595,368 | A | | 5/1952 | Plautz |
| 2,844,061 | A | * | 7/1958 | Hendrickson ..... 81/356 |
| 2,913,943 | A | | 11/1959 | Chesley et al. |
| 3,142,212 | A | | 7/1964 | Grape |
| 3,222,958 | A | | 12/1965 | Houdesheldt |
| 3,575,064 | A | | 4/1971 | Stevinson |
| 3,657,947 | A | * | 4/1972 | Myers ..... 81/134 |

(Continued)

FOREIGN PATENT DOCUMENTS

| | | |
|---|---|---|
| DE | 871579 | 3/1953 |
| DE | 29816558 | 11/1997 |

(Continued)

*Primary Examiner* — David B Thomas

(74) *Attorney, Agent, or Firm* — Gardner, Linn, Burkhart & Flory, LLP

(57) ABSTRACT

A hand operated gripping tool includes a first jaw unit having a first work piece engaging portion, a support member extending generally transversely with respect to the first jaw unit, a first handle at the second end of the support member, a second jaw unit having a second work piece engaging portion, and a second handle having an end portion pivotally attached at the second jaw unit. A guiding device is disposed at the end portion of the second handle. The guiding device has an engaging element and a biasing element, and the engaging element is biased or urged toward and into engagement with the second reaction surface by the biasing element. The engaging element engages the second reaction surface as the second jaw unit moves along the support member to adjust the size of the work piece receiving space.

19 Claims, 10 Drawing Sheets

(56) References Cited

U.S. PATENT DOCUMENTS

| | | | | |
|---|---|---|---|---|
| 3,657,949 | A | 4/1972 | Myers | |
| 3,862,776 | A | 1/1975 | Sims et al. | |
| 4,274,312 | A * | 6/1981 | Finn | 81/356 |
| 4,893,530 | A | 1/1990 | Warheit | |
| 5,660,089 | A | 8/1997 | Chow | |
| 5,964,130 | A | 10/1999 | Wang | |
| 6,026,716 | A | 2/2000 | Orlosky | |
| 6,065,376 | A | 5/2000 | Khachatoorian | |
| 6,116,124 | A | 9/2000 | Ping | |
| D431,435 | S | 10/2000 | McCalla et al. | |
| 6,155,142 | A | 12/2000 | Bally et al. | |
| 7,313,989 | B1 | 1/2008 | Tortolani | |
| 8,434,391 | B2 | 5/2013 | Buchanan | |
| 8,561,506 | B2 * | 10/2013 | Buchanan et al. | 81/407 |
| 8,677,865 | B2 * | 3/2014 | Buchanan et al. | 81/407 |
| 2009/0056510 | A1 | 3/2009 | Buchanan et al. | |
| 2009/0178518 | A1 | 7/2009 | Buchanan | |
| 2011/0232429 | A1 | 9/2011 | Buchanan | |
| 2012/0297938 | A1 * | 11/2012 | Lai | 81/356 |

FOREIGN PATENT DOCUMENTS

| | | |
|---|---|---|
| GB | 18585 | 0/1901 |
| GB | 844490 | 1/1958 |
| GB | 2072081 | 9/1981 |
| JP | 09001468 | 6/1995 |

* cited by examiner

ADJUSTABLE GRIPPING TOOL

CROSS REFERENCE TO RELATED APPLICATIONS

The present application claims the filing benefits of U.S. provisional applications, Ser. No. 61/660,275, filed Jun. 15, 2012; Ser. No. 61/611,069, filed Mar. 15, 2012; and Ser. No. 61/595,375, filed Feb. 6, 2012, which are hereby incorporated herein by reference in their entireties.

FIELD OF THE INVENTION

The present invention relates generally to pliers or hand operated gripping tools and, more particularly, to hand operated gripping tools that are adjustable to any size of work piece within the range of the jaws of the tool. One form of hand operated gripping tool to which the present invention is particularly applicable is pliers of the type generally referred to as water pump pliers or slip joint pliers.

BACKGROUND TO THE INVENTION

Existing water pump pliers or slip joint pliers have the common characteristic of jaws offset at an angle to the pliers' handles and a pivot post, in the form of a bolt or rivet, mounted in the area rearward of the jaw on one of the handles and projecting through an elongate slot on the other handle. In such pliers, means for enabling selective spacing of the distance between the jaws may take the form of spaced apart ridges or teeth provided along the inside long edge of the slot and adapted for incremental selective binding engagement with the pivot post. Another well known way of providing distance adjustment between the jaws in such pliers is to provide spaced apart arcuate ridges on the facing surfaces of the slot for engagement by the pivot post. All such tools require a two-handed operation to adjust the jaw spacing the size of a work piece to be gripped between the jaws. This adjustment involves pulling the handles apart to permit the pivot post to slide along the slot to move the movable one of the jaws to a position that provides a jaw spacing approximating to the size of the work piece that is to be gripped.

Other known types of pliers are adapted to slidably close upon a work piece in response to manual closing of the handles and, in response to contact with the work piece, automatically lock against further sliding action by engaging suitable teeth and thereby shift from a sliding to a pivoting mode whereby continued exertion of manual force on the handles increases the gripping action upon the work piece.

SUMMARY OF THE INVENTION

The present invention provides pliers or a hand operated gripping tool comprising a first or fixed jaw unit having a work piece engaging portion and a second or movable jaw unit having a work piece engaging portion and movable relative to the first jaw unit such that a variable size work piece receiving space is defined between the work piece engaging portions. The pliers includes a handle for applying a force to the second jaw unit, whereby the second jaw unit is engagable with a first reaction surface of a neck or support member of the first jaw unit such that, in use, and in response to the force applied by the handle, the work piece engaging portion of the second jaw unit is forced against a work piece received in the work piece receiving space. The second jaw unit comprises an elongate extension portion extending from the work piece engaging portion that is pivotally attached at the handle. The handle includes a guiding device or biased engaging element at its end at which the second jaw unit is attached, and the guiding device engages a second reaction surface of the neck of the first jaw unit (with the second reaction surface being opposite from the first reaction surface). The guiding device is biased so that an engaging surface (such as a surface of an engaging element such as a sliding element or a surface of a rolling wheel or the like) engages (such as slidingly engages or rollingly engages) the second reaction surface during use of the pliers and as the second jaw unit is adjusted along the neck of the first jaw unit to adjust the work piece receiving space.

Optionally, the hand operated gripping tool or pliers may include a locking device for locking the second jaw unit relative to the support member and the first jaw unit to fix the size of the work piece receiving space. The locking device may include a locking member movable to a withdrawn non-operative position. The locking member includes a lever arm that extends at least partially along the handle of the second jaw unit, and the lever arm is configured to be selectively actuated by a user of the hand operated gripping tool to release the locking device.

These and other objects, advantages, purposes and features of the present invention will become apparent upon review of the following specification in conjunction with the drawings.

BRIEF DESCRIPTION OF THE DRAWINGS

In order that the invention may be well understood, some embodiments thereof, which are given by way of example only with reference to the drawings in which.

DETAILED DESCRIPTION OF THE ILLUSTRATED EMBODIMENTS

Figure 1:
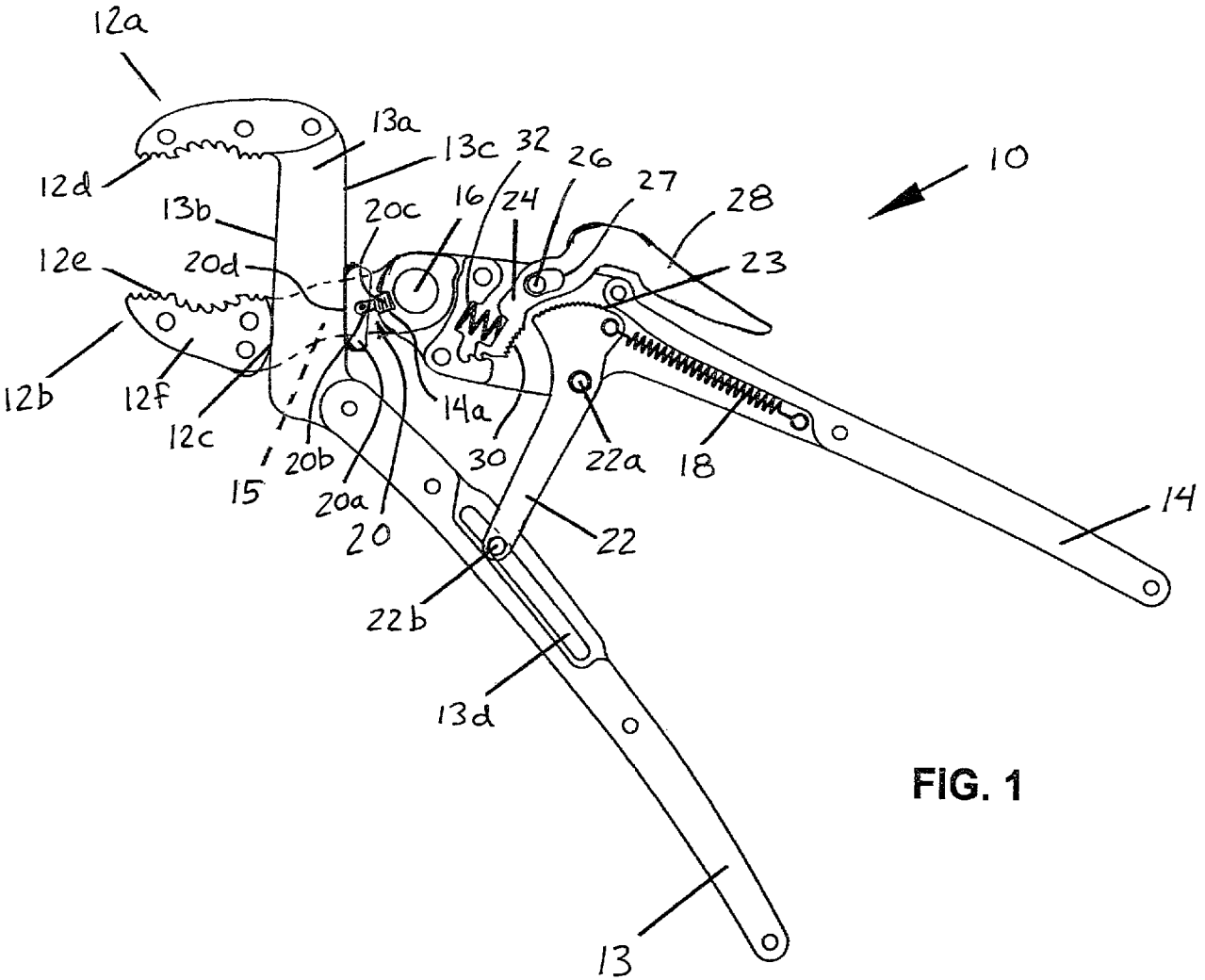
FIG. 1 is a plan view of a hand operated gripping tool of the present invention, shown with a locking device of the tool in an operative, but unlocked condition, and shown with a sliding spring-biased element, with portions of the tool removed to show additional detail.

Referring now to the drawings and the illustrative embodiments depicted therein, a hand operated gripping tool in the form of pliers 10 comprise a first or fixed jaw unit 12*a*, a second or movable jaw unit 12*b*, a fixed handle 13 and a pivotable handle 14 (FIGS. 1-4). Each jaw unit 12*a*, 12*b* has a work piece engaging portion provided with jaw gripping profiles 12*d*, 12*e*. The movable jaw unit 12*b* can be moved relative to the fixed jaw unit 12*a* by operation of the pivotable handle 14 to move the movable jaw unit 12*b* along a neck or support member 13*a* of the fixed jaw unit 12*a* and fixed handle 13 to provide a variable size work piece receiving space between the jaw gripping profiles 12*d*, 12*e*. The jaw units 12*a*, 12*b*, fixed handle 13 and pivotable handle 14 may comprise laminate structures (or may comprise any other suitable structure, such as a solid structure or drop-forged metallic structure or the like). In FIGS. 1 to 4, the uppermost (as viewed in the drawings) laminations have been removed to reveal internal features of the pliers 10. The pliers 10 may utilize aspects of the pliers disclosed in U.S. patent application Ser. No. 12/261,525, filed Oct. 30, 2008, which is hereby incorporated herein by reference in its entirety. The pivotable handle 14 includes a guiding device 20 (that includes a spring-biased or spring-loaded sliding or rolling element or the like) that engages the support member 13*a* to assist in guiding the second or movable jaw unit 12*b* along the support member 13*a* and to provide enhanced movement of the movable jaw unit when the user of the pliers adjusts the size of the work piece receiving space, as discussed below.

In the illustrated embodiment, the fixed jaw unit 12*a* is connected with the support member 13*a*, which extends generally transverse to the fixed jaw unit 12*a* (in the illustrated embodiment the jaw support member extends approximately perpendicular to the fixed jaw unit). The fixed handle 13 is connected with an end of the support member 13*a* such that the support member extends between and connects the fixed handle 13 to the fixed jaw unit 12*a*. The fixed handle 13, support member 13*a* and fixed jaw unit 12*a* may be fixed relative to one another and may comprise one or more unitary metallic elements to provide a generally or substantially rigid and fixed handle, support member and jaw unit.

The movable jaw unit 12*b* is able to move along the support member 13*a* to vary the size of the work piece receiving space. The support member 13*a* defines a first reaction surface 13*b* and a second reaction surface 13*c*. The first and second reaction surfaces 13*b*, 13*c* are disposed in oppositely facing spaced apart relation along the support member 13*a*. The movable jaw unit includes a cam or engaging surface 12*c* that opposes and engages first reaction surface 13*b* of support member 13*a*, while the end of pivotable handle 14 supports the guiding device 20 that is biased outward from the end of the pivotable handle 14 and is biased toward and into engagement with the second reaction surface 13*c* of support member 13*a*. Thus, the guiding device 20 engages the support member as the movable jaw unit 12*b* is moved along the support member to adjust the size or gap of the work piece receiving space, and thus to enhance the sliding movement of the movable jaw unit 12*b* along the support member and relative to the fixed jaw unit 12*a*.

In the illustrated embodiment of FIGS. 1-5, the guiding device 20 comprises an engaging element or sliding element 20*a* that is attached (such as pivotally attached) on a mounting arm or support element 20*b*, with an opposite or base end of the arm 20*b* being received in a slot or channel 14*a* at the end region of the pivotable handle 14. A spring or biasing element 20*c* (such as a metallic coil spring or resilient elastomeric biasing element or the like) is disposed in the slot or channel 14*a* and functions to bias and urge the arm 20*b* outward from the slot or channel to bias and urge the arm and sliding element toward and into engagement with the support member 13*a*. The sliding element 20*a* may have a curved engaging surface 20*d* (FIG. 5) to enhance sliding movement of the sliding element along the reaction surface 13*c* and to limit or substantially preclude binding of the sliding element as it moves or slides along the second reaction surface as the movable jaw unit is moved to adjust the work piece receiving space. The engaging surface 20*d* may comprise a generally smooth and uniform or consistent surface that may maintain a substantially constant pressure on the spine or neck or support member of the upper or fixed jaw unit throughout the range of movement of the lower or movable jaw unit along the support member.

Figure 2:
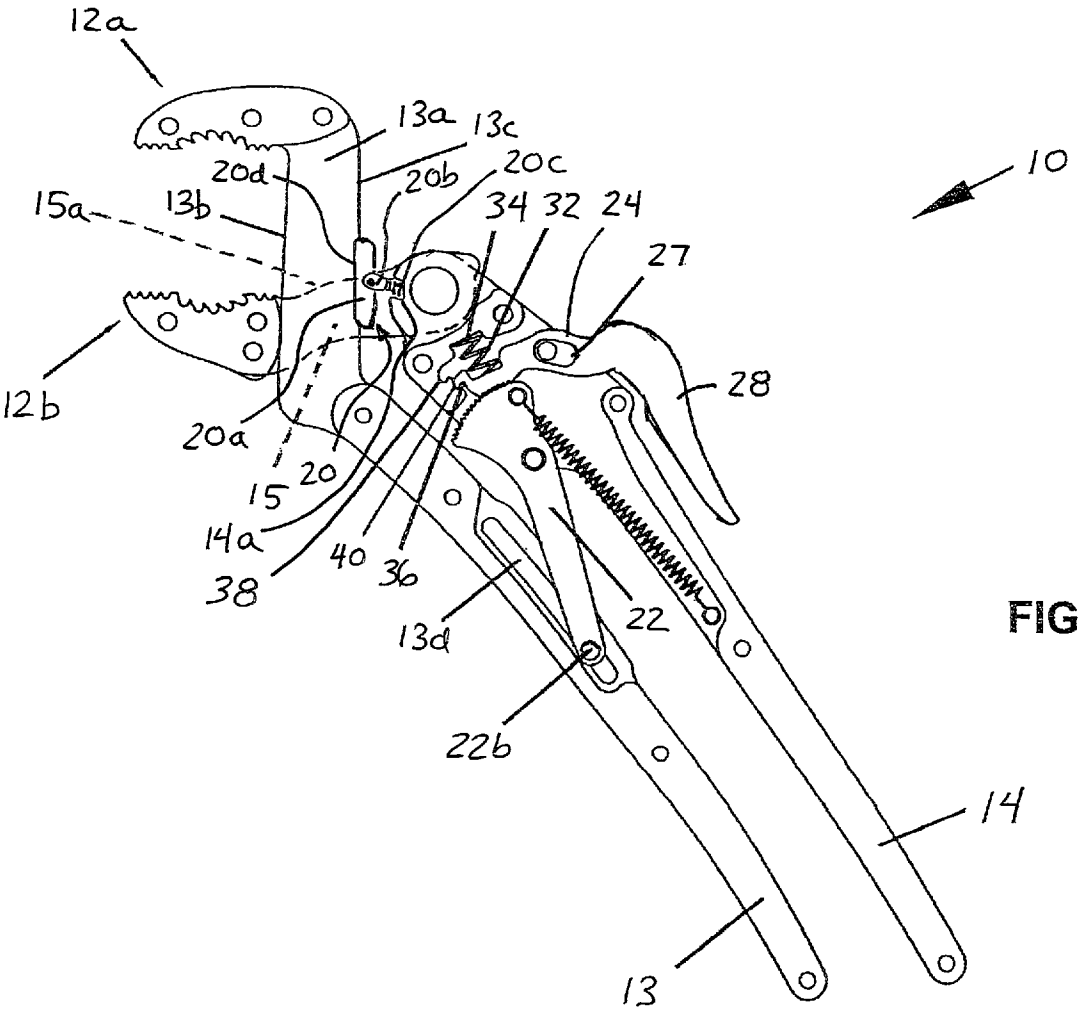
FIG. 2 is another plan view of the hand operated gripping tool of FIG. 1, shown with the locking device in a locking condition.
Figure 3:
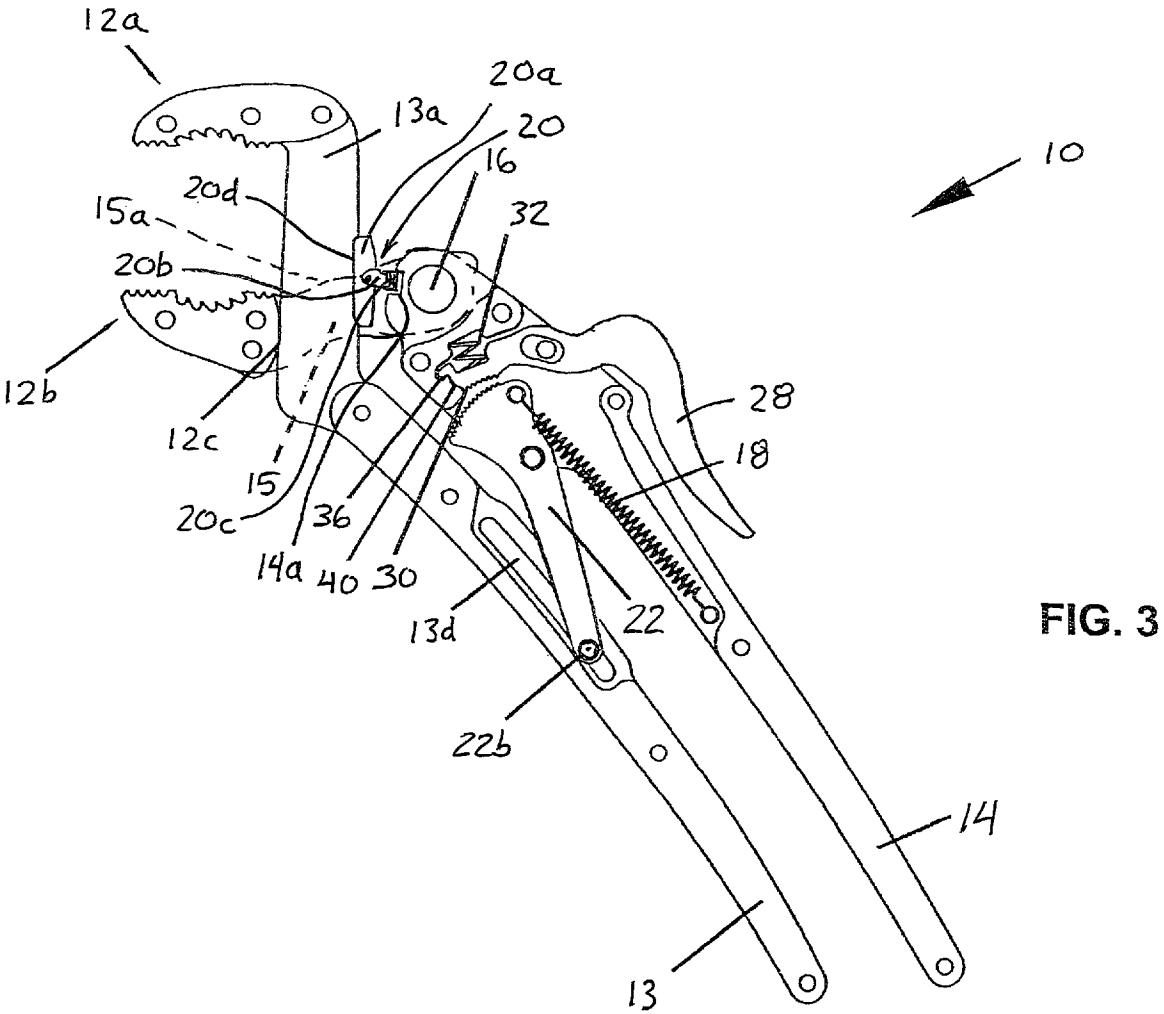
FIG. 3 is another plan view of the hand operated gripping tool of FIG. 1, shown with the locking device in withdrawn non-operative condition.

In the illustrated embodiment, the movable jaw unit 12*b* comprises a laminate structure comprising a jaw center member 12*f* and an extension portion comprising two elongate link members 15 (with only one of the link members 15 shown in FIGS. 1-3 and with one removed to show additional details). The link members 15 are spaced apart so that the support member 13*a* is received between the link members 15, while the center member 12*f* is disposed between and attached to or laminated with the link members 15 and at or adjacent to the support member 13*a*. In FIGS. 1 to 3, the uppermost link member 15 (as viewed in the drawings) has been removed to reveal internal features of the pliers 10. The movable jaw unit 12*b* comprises a cam surface 12*c*, which is defined by the jaw center member 12*f* and is engagable with the first reaction surface 13*b*. The link members 15 are attached to the sides of a jaw center member 12*f* such that the jaw center member is sandwiched between the link members to form the laminated jaw unit. The portions of the link members 15 that are attached against the sides of the jaw center member 12*f* are shaped to correspond to the profile of the jaw center member and so include jaw gripping profiles 12*d*, 12*e*. The link members 15 extend from the jaw center member 12*f* and are disposed in opposed spaced apart relation to define a gap therebetween. The support member 13*a* extends through the gap defined between the link members 15.

Likewise, the pivotable handle 14 may comprise a laminate structure, and may have two outer plates or handle portions that sandwich the support portion of the guiding element 20 therebetween. The pivotable handle 14 is pivotally connected with movable jaw unit 12*b* by means of a pivot pin 16 (which may be received through the support portion of the guiding element 20, which is fixedly disposed at the end of the handle 14) at a connection location adjacent the respective free ends of the link members 15, and at or near where the biased engaging element or guiding device 20 is attached or mounted at the pivotable handle 14. Optionally, the link members 15 may comprise a bend, or flexure, promoting portion 15*a*, such as described in U.S. patent application Ser. No. 12/261,525, filed Oct. 30, 2008, which is hereby incorporated herein by reference in its entirety. When the movable jaw unit 12*b* is assembled to the support member 13*a*, the bend promoting portion 15*a* is disposed between the first reaction surface 13*b* and the connection location at which the pivotable handle 14 is connected to the movable jaw unit 12*b* by the pivot pin 16.

In the illustrated embodiment, a pivotable link 22 extends between the fixed handle 13 and pivotable handle 14. The pivotable link 22 is pivotally connected to the fixed handle 13 by a pivot pin 22*b* that is slidably received in a slot 13*d* defined in the fixed handle 13 (although shown and described as a pivot pin 22*b*, the engaging or guiding element may comprise any suitable guiding element, such as a roller or ball bearing or the like, which may provide enhanced or smooth guiding movement of the end of the link along the handle 13). The slot 13*d* extends in the lengthways direction of the fixed handle 13 and when the uppermost (as viewed in the drawing) lamination of the handle is in place, cannot be readily seen or viewed by a person using the tool 10. The pivotable link 22 is pivotally connected to the pivotable handle 14 by a pivot pin 22*a*. A biasing member in the form of a tension spring 18 is connected to the pivot pin 22*a* and a location on the pivotable handle 14 and is arranged to bias the pivotable handle to the position shown in FIG. 1, which is the fully open condition of the pliers in which the work piece receiving space defined between the jaw units 12*a*, 12*b* is at its maximum extent.

The pliers 10 are provided with an automatic locking device that comprises teeth 23 provided on the end of the pivotable link 22 adjacent the pivot pin 22*a* and a locking member 24. The locking member 24 is pivotally mounted on the pivotable handle 14 via a pivot pin 26. The pivot pin 26 is fixed to the pivotable handle 14 and extends through a lengthways extending slot 27 (FIGS. 1 and 2) provided in the locking member 24. The locking member 24 has a thumb tab or release lever 28 for actuation by a user of the pliers 10. When the uppermost lamination of the pivotable handle 14 is in place, the release lever 28 is the only portion of the locking member 24 that is readily visible or viewable by a user of the pliers. In the illustrated embodiment, the release lever 28 comprises an elongated lever arm that extends partially along the pivotable handle 14 such that the user of the pliers, when grasping handles 13, 14, can readily actuate or move release lever 28 to release the locking device to allow for movement of the movable jaw unit along the support member and relative to the fixed jaw unit to adjust the work piece receiving space.

Figure 4:
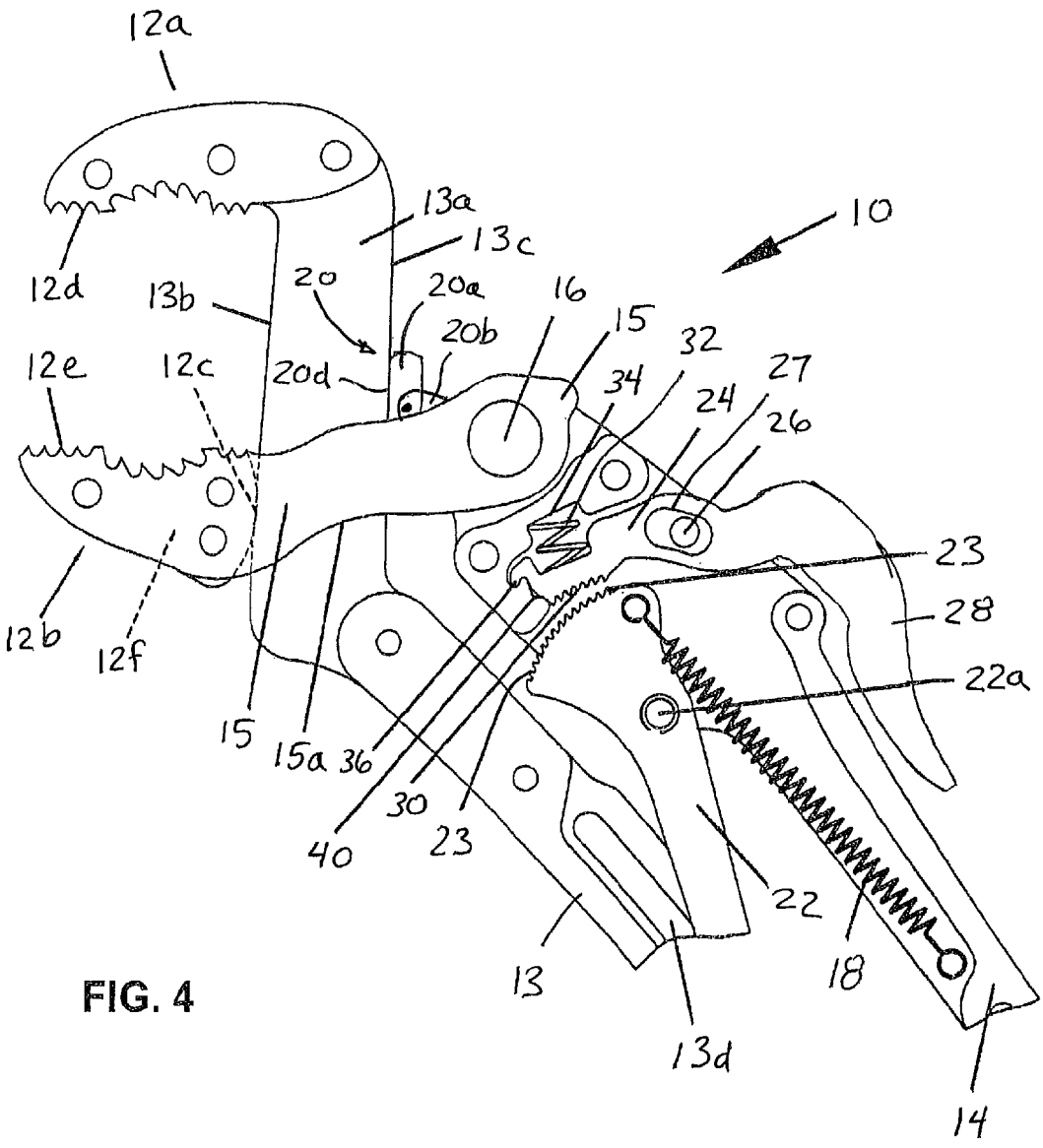
FIG. 4 is an enlarged view of a portion of FIG. 3, showing the movable jaw unit of the hand operated gripping tool in greater detail.

Referring particularly to FIGS. 2 and 4, at the end of the locking member 24 opposite the release lever 28, the side of the member facing away from the pivotable handle pin 16 is provided with teeth 30 for engaging the teeth 23 on the pivotable link 22. On the other side of the locking member 24 opposite the teeth 30, there is a recess that houses an end of a resilient member or biasing element, which in this embodiment is compression spring 32. The opposite end of compression spring 32 is held in a recess 34 provided in the pivotable handle 14. As best seen in FIG. 4, the toothed end of the locking member 24 is provided with a nose-like projection 36 that engages in recesses 38, 40 provided in the pivotable handle 14 to locate the locking member 24 in its inoperative and operative positions respectively. The compression spring 32 biases the locking member 24 to the operative position shown in FIGS. 1 and 2 in which the projection 36 engages in the recess 40 and the member is able to automatically engage the teeth 23 provided on the end of the pivotable link 22. When the projection 36 is engaged in the recess 38, the locking member is held in a withdrawn position in which it cannot engage with the pivotable link 22. Thus, the locking member 24 can be locked in a withdrawn inoperative position. This means that, when desired, the pliers 10 can be used without the automatic locking device. When a user wishes to activate the automatic locking device, the release lever 28 is used to slide the locking member 24 outwardly with respect to the pivotable handle 14 to withdraw the projection 36 from the recess 38. Once the projection 36 is clear of the recess 38, the compression spring 32 acts against the toothed end of the locking member to move the locking member to the operative position shown in FIGS. 1 and 2 in which it is ready to automatically engage the pivotable link 22.

In FIG. 2, the teeth 30 on the locking member 24 are shown engaging the teeth 23 on the pivotable link 22, thereby locking the jaw units 12*a*, 12*b* in the position shown. The teeth 23, 30 are shaped such that as the pivotable link 22 pivots from the position shown in FIG. 1 to the position shown in FIG. 2, they automatically engage in the manner of a ratchet. The biasing force provided by the compression spring 32 presses the teeth 30 into the teeth 23, thereby ensuring that locking engagement is maintained.

The lock can be released by pushing down (as viewed in FIG. 1) on the release lever 28 to cause the toothed end of the locking member 24 to pivot clockwise to release the pivotable link 22 and allow free movement of the pivotable handle 14 relative to the fixed handle 13. When the release lever 28 is released, the toothed end of the locking member 24 is returned to the position shown in FIG. 1 so that the locking member is ready to automatically engage the teeth 23 of the pivotable link 22. When the release lever 28 is released, the movable jaw unit can be readily moved along the support member and relative to the fixed jaw unit, with the biased engaging element guiding the movement of the movable jaw unit along the support member and limiting binding of the movable jaw unit relative to the support member as it is moved therealong to adjust the work piece receiving space.

Figure 6:
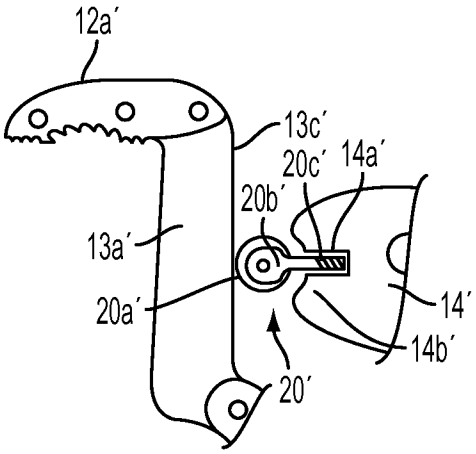
FIG. 6 is a plan view similar to FIG. 5, showing a rolling spring-biased element in accordance with the present invention.
Figure 5:
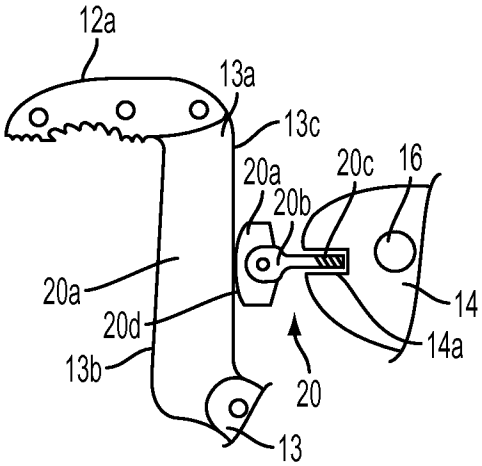
FIG. 5 is a plan view of a fixed jaw and sliding spring-biased element of the present invention.
Figure 7:
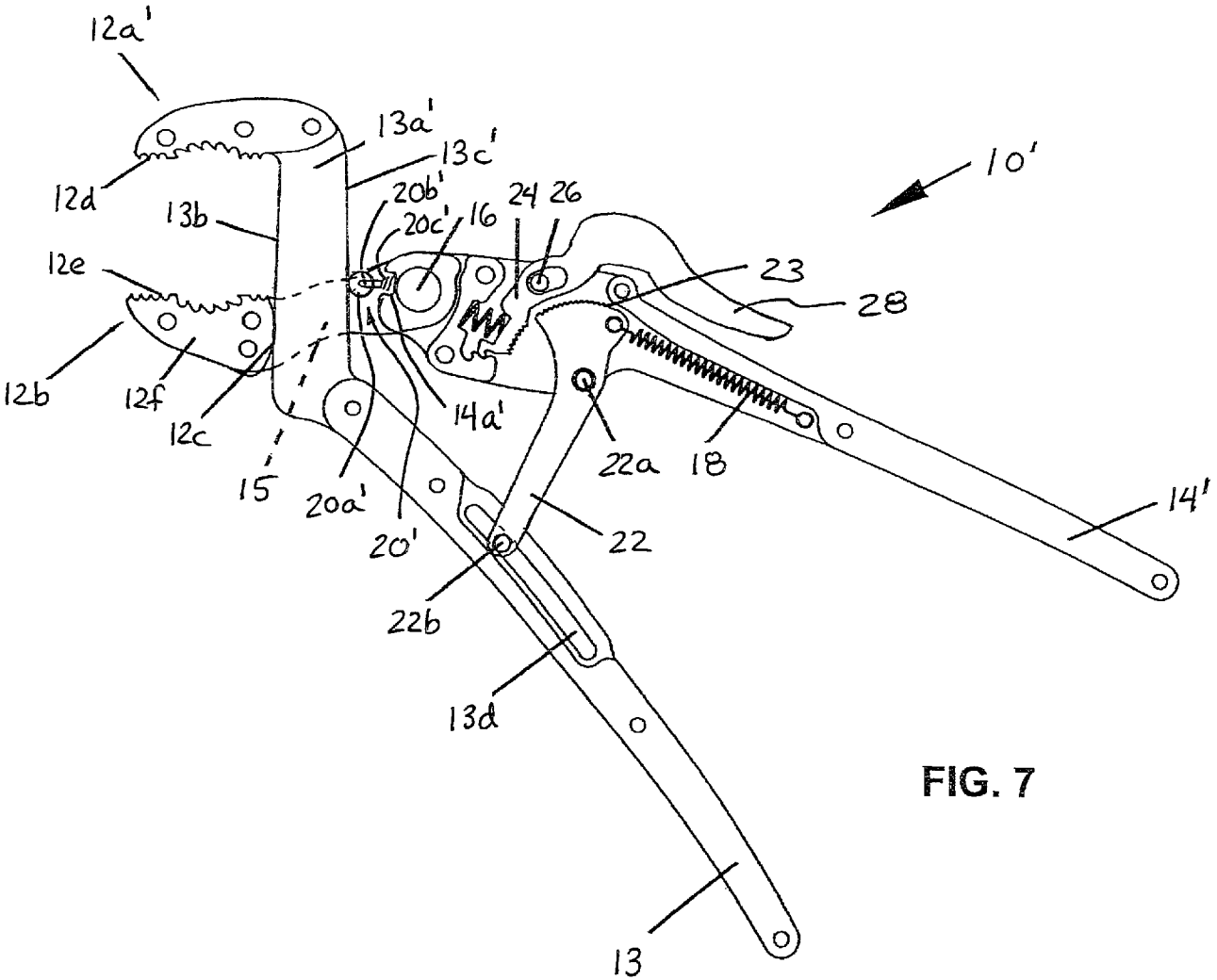
FIG. 7 is a plan view of another hand operated gripping tool of the present invention, shown with a locking device of the tool in an operative, but unlocked condition, and shown with a rolling spring-biased element, with portions of the tool removed to show additional detail.

Although shown and described as having a sliding element biased toward and into engagement with the second reaction surface of the neck or support member of the fixed jaw unit and fixed handle, the biased engaging element may comprise any suitable element that is biased or urged outward from the end of the fixed handle toward and into engagement with the second reaction surface of the neck or support member of the fixed jaw unit and fixed handle, while remaining within the spirit and scope of the present invention. For example, and with reference to FIGS. 6 and 7, a biased engaging element or guiding device 20' comprise a rolling element or wheel 20*a*' that is pivotally or rotatably attached on an arm or support element 20*b*', with an opposite or base end of the arm 20*b*' being at least partially received in a slot or channel 14*a*' at the end region of the pivotable handle 14'. A spring or biasing element 20*c*' (such as a metallic coil spring or resilient elastomeric biasing element or the like) is disposed in the slot or channel 14*a*' and functions to bias and urge the arm 20*b*' outward from the slot or channel to bias and urge the arm and rolling element toward and into engagement with the support member 13*a*'. The rolling element 20*a*' thus may rollingly engage and roll along the reaction surface 13*c*' to enhance movement of the rolling element along the reaction surface 13*c*' as the movable jaw unit is moved along the support member and relative to the fixed jaw unit 12*a*' to adjust the work piece receiving space. As shown in FIG. 6, the end 14*b*' of the pivotable handle 14' may be formed to partially receive the rolling element or wheel 20*a*' to as to partially house or encompass the wheel at the end of the handle 14', thereby limiting exposure of the wheel during use of the tool. The wheel 20*a*' may comprise a generally smooth and uniform or consistent surface that may maintain a substantially constant pressure on the spine or neck or support member of the upper or fixed jaw unit throughout the range of movement of the lower or movable jaw unit along the support member. The guiding device thus may provide enhanced accuracy and consistency for the pliers, and may provide enhanced or smoother operation of the pliers as they are opened, closed, locked and/or released by the user. As shown in FIG. 7, the guiding device 20' may be implemented in pliers 10' (and without the end portion of the handle 14' partially receiving the wheel therein as shown in FIG. 6), which are, in the illustrated embodiment, similar to pliers 10, discussed above, such that a detailed discussion of the pliers need not be repeated herein. The reference numbers in FIG. 7 for the common or similar components of the pliers are the same as the reference numbers used in FIGS. 1-4.

Figure 8:
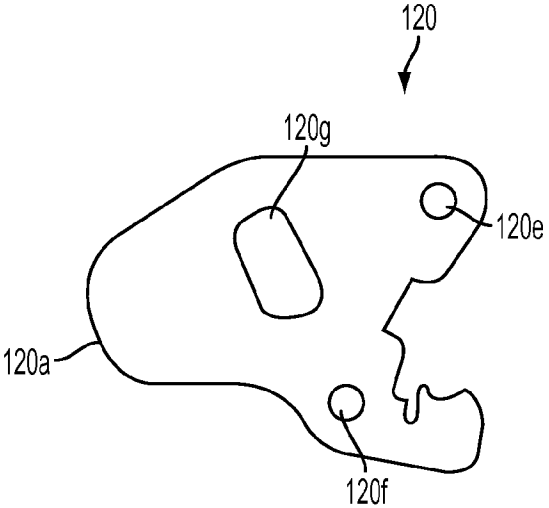
FIG. 8 is a side elevation of a portion that is attached at the end of a handle for movably engaging a neck of a fixed jaw during operation of the pliers, in accordance with the present invention.

Optionally, other means for movable engagement between the movable handle and the neck of the fixed jaw may be implemented while remaining within the spirit and scope of the present invention. For example, and with reference to FIG. 8, an end portion or guiding portion or element 120 of a movable handle (that may be sandwiched between two laminate portions of the handle and pinned thereto via pins at apertures 120*e*, 120*f*) includes an aperture or slot 120*g* for receiving a pin therethrough for pivotally attaching the movable jaw to the handle, as discussed above. In the illustrated embodiment, the aperture 120*g* comprises an elongated slot that the pin can pivot in and can slide along during user of the pliers. The slotted configuration allows the pliers to have increased torque when the handles are squeezed together, as compared to the torque provided with a typical round pivot pin in a round hole. The slot may be any suitable dimensions and the pin may have a reduced diameter over pin 16, in order to fit in and move along the elongated slot 120*g*. As also shown in FIG. 8, the end or engaging portion 120*a* of the guiding element 120 may be unitarily formed with the rest of the guiding element (with no spring biasing element or the like), and may comprise a generally rounded engaging surface for sliding engagement along the neck of the fixed jaw during adjustment of the pliers. Such a configuration may make substantially solid sliding contact when the jaw is engaged, but may barely contact the neck when the jaw is not engaged so as to reduce friction when the pliers handles are squeezed. Other types of guiding elements or surfaces (such as spring biased elements or rollers or wheels or the like) may be implemented with the slotted guiding element of the type shown in FIG. 8, while remaining within the spirit and scope of the present invention.

Figure 9:
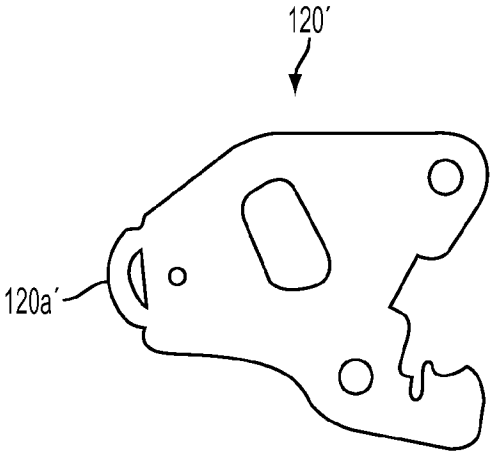
FIG. 9 is a side elevation of another portion that is attached at the end of a handle for movably engaging a neck of a fixed jaw during operation of the pliers, in accordance with the present invention.

For example, and with reference to FIG. 9, a guiding element 120' of the pliers of the present invention may be substantially similar to guiding element 120, discussed above, but may have a roller or wheel 120*a'* rotatably mounted at the end portion of the guiding element 120' so as to provide rolling contact with the neck of the fixed jaw during use of the pliers. The roller may have a generally fixed pivot axis or axle at the end portion of the guiding element, or the roller may be rotatably mounted at a movable and spring-loaded element so that the roller may move inwards and outwards relative to the guiding element during use of the pliers.

Figure 10:
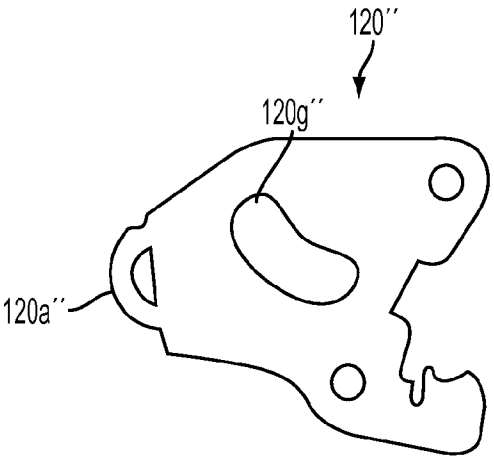
FIG. 10 is a side elevation of another portion that is attached at the end of a handle for movably engaging a neck of a fixed jaw during operation of the pliers, in accordance with the present invention.

Optionally, and with reference to FIG. 10, a guiding element 120" of the pliers of the present invention may be substantially similar to guiding element 120', discussed above, but the aperture or slot 120*g"* may comprise a curved or arcuate slot (such as generally in a kidney bean shape or configuration). The curved slot may provide enhanced movement and enhanced torque at the jaws when the handles are squeezed together. With such a configuration, the action of the pliers is improved in smoothness and the process of how the lower or movable jaw moves into position for gripping is enhanced. The slotted attachment and/or curved slotted attachment may also allow the ratcheting assembly and movement to be utilized in various designs or applications and makes it easier to engage and disengage the jaws. Although shown with the slot curved in one direction, it is envisioned that the curved slot may be curved in the opposite direction or may have a non-uniform curvature or complex curvature, depending on the particular application of the pliers and the desired feel and control of the pliers when the user is squeezing the handles together.

In the illustrated embodiment, the roller or wheel 120*a"* is rotatably mounted at the end portion of the guiding element 120" to provide rolling contact with the neck of the fixed jaw during use of the pliers. Optionally, and as discussed above, the roller may have a generally fixed pivot axis or axle at the end portion of the guiding element, or the roller may be rotatably mounted at a movable and spring-loaded element so that the roller may move inwards and outwards relative to the guiding element during use of the pliers. Other types of guiding elements or surfaces (such as fixed elements or spring biased elements or rollers or wheels or the like) may be implemented with the curved slotted guiding element of the type shown in FIG. 9, while remaining within the spirit and scope of the present invention.

Referring now to FIGS. 11-14, a hand operated gripping tool in the form of pliers 210 comprise a first or fixed jaw unit 212*a*, a second or movable jaw unit 212*b*, a fixed handle 213 and a pivotable handle 214. Each jaw unit 212*a*, 212*b* has a work piece engaging portion provided with jaw gripping profiles. The movable jaw unit 212*b* can be moved relative to the fixed jaw unit 212*a* by operation of the pivotable handle 214 to move the movable jaw unit 212*b* along a neck or spine or support member 215 of the fixed jaw unit 212*a* and fixed handle 213 to provide a variable size work piece receiving space between the jaw gripping profiles of the jaw units. The jaw units 212*a*, 212*b*, fixed handle 213 and pivotable handle 214 may comprise drop forged metallic elements or may comprise laminate structures (or may comprise any other suitable structure, such as a solid structure or the like).

Figure 11:
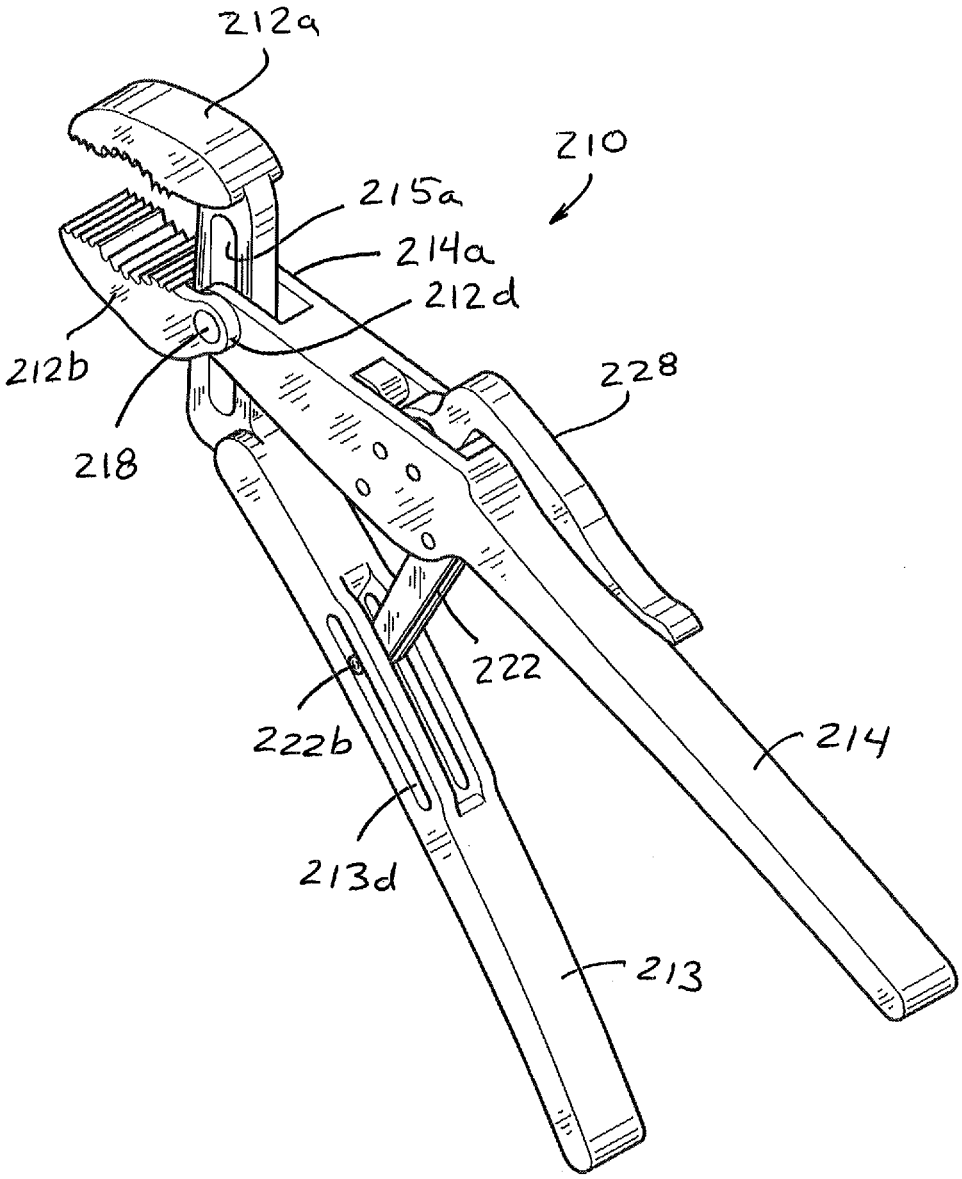
FIG. 11 is a perspective view of another hand operated gripping tool of the present invention.
Figure 12:
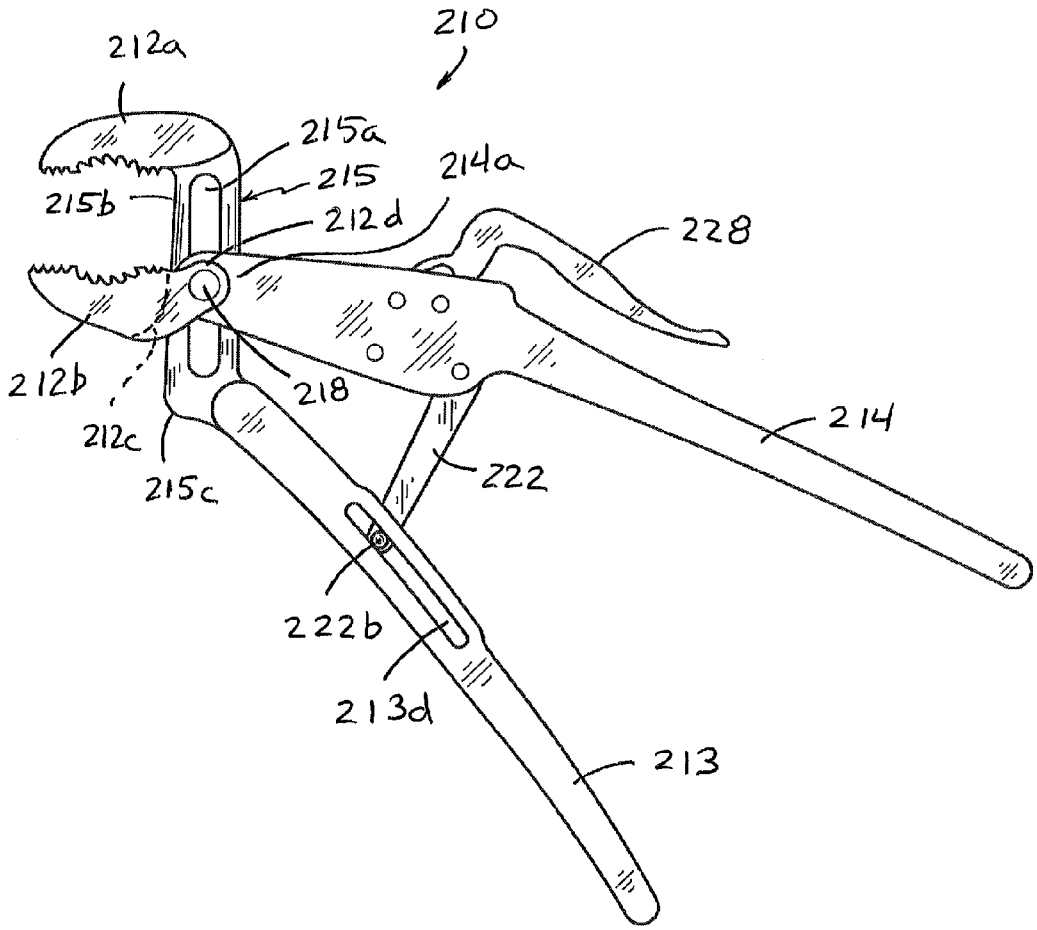
FIG. 12 is a side elevation of another hand operated gripping tool of FIG. 11.
Figure 13:
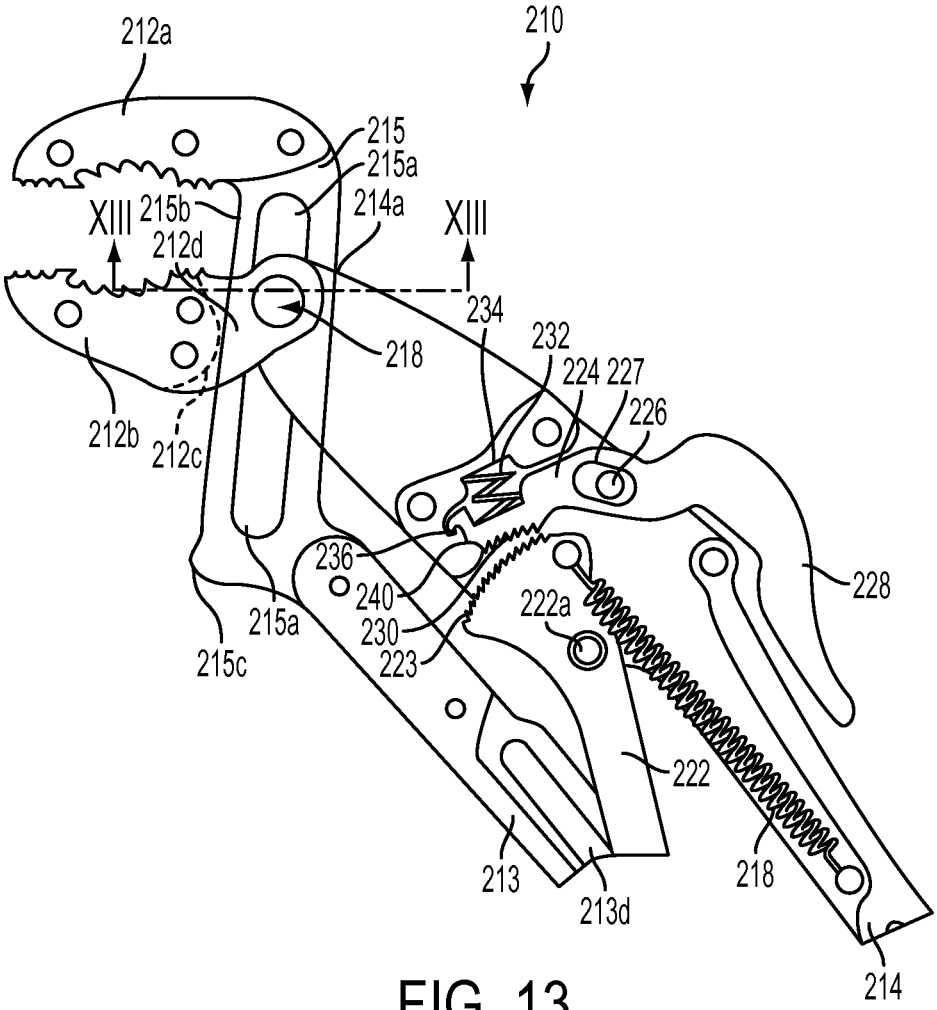
FIG. 13 is a side elevation of the hand operated gripping tool of FIGS. 11 and 12, with portions removed to show additional details.
Figure 14:
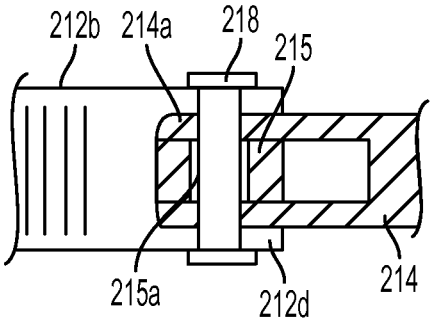
FIG. 14 is a sectional view of the hand operated gripping tool taken along the line XIII-XIII in FIG. 13.

As shown in FIGS. 11-14, the tool 210 has a slot 215*a* in the center of the spine or support member 215 of the upper or fixed jaw and lower or fixed handle and a pin 218 (such as a hardened pin, such as a 3/16 inch or 5 mm hardened pin or other suitably sized pin) is received in the slot 215*a* and acts as a guide to keep the jaws in alignment while sliding up and down along the spine 215. As can be seen in FIGS. 11 and 14, the movable jaw unit 212*b* may be formed as a yoke or "U" shape with tabs or arms 212*d* that extend over corresponding tabs or arms or walls 214*a* of the pivotable handle 214 (also formed as a yoke or "U" shape), which extend over the spine 215. The pin 218 is received through an aperture or hole in each of the arms or walls 212*d* of the movable jaw unit 212*b*, an aperture or hole in each of the arms or walls 214*a* of the pivotable handle 214 and the slot 215*a* of the spine 215, thus pivotally attaching the jaw unit 212*b* at the movable handle 214 and guiding the handle and jaw unit along the slot in the spine during use of the tool.

The movable handle thus may be configured to house only the trigger assembly and spring as the ratcheting mechanism be substantially similar to the ratcheting mechanism discussed above. The movable handle may be forged with a slot opening to insert the modified ratchet mechanism parts and to rivet the parts to secure them in the handle. The end of the upper handle that engages the spine of the lower handle/upper jaw comprises a yoke or "U" shape allowing close tolerance to the spine area, while the lower or movable jaw also comprises a yoke or "U" shape fitting over the top of the upper handle yoke with the hardened pin fitting through the entire assembly, making a very strong and precise moving jaw assembly for the tool or pliers.

During use, the movable handle and pin can move up or down along the slot of the spine to adjust the gap size or opening size of the jaws. As can be seen with reference to FIG. 12, the movable jaw 212*b* may have an inner curved surface 212*c*, which moves along the surface 215*b* of the spine 215 and allows for the lower or movable jaw unit 212*b* to open wider when the jaw unit 212*b* is moved to the far end of the spine from the fixed jaw unit 212*a*. Thus, the curved surface allows the movable jaw unit to pivot relative to the movable handle and relative to the spine or support member to a fully open orientation such that the work piece engaging portion of the movable jaw unit diverges from the work piece engaging portion of the fixed jaw unit away from the spine or support member. In the illustrated embodiment, the spine 215 includes a bump or rest or stop 215*c* against which the lower jaw unit 212*b* may rest when at its lowermost position.

When the lower or movable jaw unit 212*b* is moved into engagement with a work piece, squeezing of the handles 214, 213 together clamps the jaw units toward one another (while the pin 222*b* of the ratchet mechanism does not move along the slot 213*d* of the fixed handle 213). When the jaw units are applying the desired clamping force and/or are at the desired or appropriate relative separation, the ratchet mechanism may function (via the pin 222*b* moving along slot 213*d*) to hold the jaws in that position. The handle slot 213*d* may comprise a substantially straight slot as shown, or may comprise a curved slot to provide varying control of the tool as the pin 222*b* moves along the slot 213*d*. The ratcheting mechanism may be similar to the ratcheting mechanism discussed above, such that a detailed discussion of the ratcheting mechanism need not be repeated herein. The reference numbers in FIGS. 11-14 are similar to the reference numbers used in FIG. 4, discussed above, for the common or similar components, but with 200 added to each number.

Therefore, the gripping tool 210 provides a stronger and less limited tool as to the way the lower jaw may self-adjust. By positioning the pivot point inside the spine so that it slides up and down on a pin inside of the lower jaw assembly, the pliers will be much more precise and have reduced moving parts. The strength should be enhanced because the tool has the pivot and connection joint or pin through the lower jaw assembly rather than around it or behind it. The slot in the bottom handle will be relative to the slot that allows the movement of the lower jaw up and down for gripping materials. The two slots (in the spine and in the fixed handle) will allow for self-adjustability of the tool as they work in opposite directions to ensure the jaws' adjustment and the ratcheting and locking adjustment. The sequence of the action of the tool has the upper slot engaged first until the jaws contact the surface or work piece to be gripped, and when that contact is made, the lower slot may be engaged to allow the ratcheting mechanism to come into effect and lock the handles in place. Due to the pivot placement and rounded contact area against the upper jaw inside (jaw side) spine surface, the jaws of the tool 210 may open wider than standard types of pliers, allowing all shapes of materials within the size limit of the tool to be gripped in such a way as to be secure in the jaws once locked. The jaws of the tool thus are variable and self-adjusting during use to grip all types and shapes of materials within the limits of the size of the opening of the jaws.

The geometrical proportions of the pliers can be varied to suit many different applications and gripping forces. It will be appreciated that other pliers with fixed and movable jaw units may have the movable jaw unit bind as it is moved along a fixed support of the fixed jaw unit. The biased engaging element or device of the present invention provides smoother enhanced movement of the movable jaw element relative to the fixed jaw element when the user of the pliers adjusts the work piece receiving space between the jaw elements.

Embodiments of the invention include a set of pliers for applying a torque to rotate fasteners, pipes/tubes and the like and especially for the operation of plumbing-type fittings. The pliers may include a locking function, which may be used to provide a 'vice grip' type clamping action that can be used for the purpose of gripping or clamping in a locking manner many differing shapes, materials or fasteners.

It will be appreciated that the gripping mechanism of the invention is not limited to pliers as shown in the embodiments. For example, the present invention could be advantageously applied to the clamping and locking mechanism of bar clamps used in such fields as carpentry.

Changes and modifications to the specifically-described embodiments may be carried out without departing from the principles of the present invention, which is intended to be limited only by the scope of the appended claims, as interpreted according to the principles of patent law, including the doctrine of equivalents.

The invention claimed is:

1. A hand operated gripping tool comprising:

a first jaw unit having a first work piece engaging portion;

a support member extending generally transversely with respect to said first jaw unit, said support member defining a first reaction surface and a second reaction surface disposed opposite from and facing away from said first reaction surface, wherein said support member has a first end proximate said first jaw unit a second end distal from said first jaw unit;

a first handle at said second end of said support member;

a second jaw unit having a second work piece engaging portion and a surface engagable with said first reaction surface and movable along said support member relative to said first jaw unit to adjust a size of a work piece receiving space between said first and second work piece engaging portions;

a second handle having an end portion pivotally attached at said second jaw unit and spaced from said second reaction surface of said support member; and a guiding device disposed at said end portion of said second handle, wherein said guiding device comprises an engaging element and a biasing element, and wherein said engaging element is biased or urged toward and into engagement with said second reaction surface by said biasing element, said engaging element engaging said second reaction surface as said second jaw unit moves along said support member to adjust the size of said work piece receiving space.

2. The hand operated gripping tool of claim 1, wherein said engaging element comprises a sliding element that slides along said second reaction surface as said second jaw unit moves along said support member and relative to said first jaw unit to adjust the size of said work piece receiving space.

3. The hand operated gripping tool of claim 2, wherein said sliding element has an arcuate engaging surface that engages said second reaction surface when said sliding element is urged toward and into engagement with said second reaction surface by said biasing element.

4. The hand operated gripping tool of claim 1, wherein said engaging element is pivotally mounted at an outer end of a mounting arm of said guiding device, and wherein said mounting arm is at least partially received in a receiving portion of said end portion of said second handle, and wherein said biasing element urges said mounting arm in a direction outward from said receiving portion.

5. The hand operated gripping tool of claim 1, wherein said biasing element comprises a coil spring.

6. The hand operated gripping tool of claim 1, wherein said engaging element comprises a wheel that rollingly engages said second reaction surface when said wheel is urged toward and into engagement with said second reaction surface by said biasing element.

7. The hand operated gripping tool of claim 6, wherein said wheel is rotatably mounted at an outer end of a mounting arm, and wherein said mounting arm is at least partially received in a receiving portion of said end portion of said second handle, and wherein said biasing element urges said mounting arm in a direction outward from said receiving portion.

8. The hand operated gripping tool of claim 1, wherein said first reaction surface comprises a first side surface of said support member that faces into said work piece receiving space and said second reaction surface comprises a second side surface of said support member that is disposed opposite and spaced from said first side surface.

9. The hand operated gripping tool of claim 1, further comprising a locking device for locking said second jaw unit relative to said support member and said first jaw unit to fix the size of said work piece receiving space, wherein said locking device comprises a locking member movable to a withdrawn non-operative position, and wherein said locking member comprises a lever arm that extends at least partially along said second handle.

10. The hand operated gripping tool of claim 9, wherein said lever arm is configured to be selectively actuated by a user of said hand operated gripping tool to release said locking device.

11. The hand operated gripping tool of claim 1, wherein said second jaw unit is pivotally attached at said second handle via a pin that moves along an elongated slot at said second handle.

12. The hand operated gripping tool of claim 11, wherein said elongated slot comprises a curved slot.

13. A hand operated gripping tool comprising:

a first jaw unit having a first work piece engaging portion;

a support member extending generally transversely with respect to said first jaw unit, said support member having a slot extending therealong;

a first handle at a second end of said support member;

a second jaw unit having a second work piece engaging portion and a surface engagable with an outer surface of said support member;

a second handle having an end portion pivotally attached at said second jaw unit;

wherein said end portion of said second handle is pivotally attached at said second jaw unit via a pin extending through apertures in said end portion and said second jaw unit, and wherein said pin extends through said slot of said support member such that said second jaw unit and said end portion of said second handle are movable along said slot of said support member relative to said first jaw unit to adjust a size of a work piece receiving space between said first and second work piece engaging portions; and wherein said second jaw unit has a generally U-shaped end and said end portion of said second handle has a generally U-shaped end, and wherein said generally U-shaped ends engage one another in overlapping fashion and receive said support member therein, with said pin extending through said generally U-shaped ends and through said slot of said support member.

14. The hand operated gripping tool of claim 13, wherein said second handle comprises a forged handle.

15. The hand operated gripping tool of claim 14, wherein said second jaw unit comprises a forged jaw unit.

16. A hand operated gripping tool comprising:

a first jaw unit having a first work piece engaging portion;

a support member extending generally transversely with respect to said first jaw unit, said support member having a slot extending therealong:

a first handle at a second end of said support member;

a second jaw unit having a second work piece engaging portion and a surface engagable with an outer surface of said support member;

a second handle having an end portion pivotally attached at said second jaw unit;

wherein said end portion of said second handle is pivotally attached at said second jaw unit via a pin extending through apertures in said end portion and said second jaw unit, and wherein said pin extends through said slot of said support member such that said second jaw unit and said end portion of said second handle are movable along said slot of said support member relative to said first jaw unit to adjust a size of a work piece receiving space between said first and second work piece engaging portions; and wherein said second jaw unit comprises an inner surface that engages an outer surface of said support member, and wherein said inner surface comprises a curved surface.

17. The hand operated gripping tool of claim 16, wherein said curved surface allows said second jaw unit to pivot relative to said second handle and relative to said support member to a fully open orientation such that said second work piece engaging portion diverges from said first work piece engaging portion away from said support member.

18. A hand operated gripping tool comprising;

a first jaw unit having a first work piece engaging portion;

a support member extending generally transversely with respect to said first jaw unit, said support member having a slot extending therealong;

a first handle at a second end of said support member;

a second jaw unit having a second work piece engaging portion and a surface engagable with an outer surface of said support member;

a second handle having an end portion pivotally attached at said second jaw unit;

a locking device for locking said second jaw unit relative to said support member and said first jaw unit to fix the size of said work piece receiving space, wherein said locking device comprises a locking member movable to a withdrawn non-operative position, and wherein said locking member comprises a lever arm that extends at least partially along said second handle; and wherein said end portion of said second handle is pivotally attached at said second jaw unit via a pin extending through apertures in said end portion and said second jaw unit, and wherein said pin extends through said slot of said support member such that said second jaw unit and said end portion of said second handle are movable along said slot of said support member relative to said first jaw unit to adjust a size of a work piece receiving space between said first and second work piece engaging portions.

19. The hand operated gripping tool of claim 18, wherein said lever arm is configured to be selectively actuated by a user of said hand operated gripping tool to release said locking device.

* * * * *